US005216394A

United States Patent [19]

Konishi et al.

[11] Patent Number: 5,216,394

[45] Date of Patent: Jun. 1, 1993

[54] DIELECTRIC MULTI-LINE RESONATOR INCLUDING A COUPLING CONDUCTOR LINE MAINLY INDUCTIVELY COUPLED TO A RESONATOR CONDUCTOR LINE

[75] Inventors: Yoshihiro Konishi, Sagamihara; Hideo Hikuma, Chiba; Hideki Fujiwara, Ichikawa, all of Japan

[73] Assignee: Uniden Corporation, Ichikawa, Japan

[21] Appl. No.: 732,766

[22] Filed: Jul. 19, 1991

[51] Int. Cl.[5] ..... H01P 7/04; H01P 5/12; H01P 1/205

[52] U.S. Cl. ..... 333/222; 333/134; 333/136; 333/206

[58] Field of Search ..... 333/134, 202, 206, 207, 333/222, 136, 219

[56] References Cited

U.S. PATENT DOCUMENTS 4,410,868 10/1983 Meguro et al. ..... 333/202

FOREIGN PATENT DOCUMENTS

| | | | |
|---|---|---|---|
| 0364931 | 4/1990 | European Pat. Off. | 333/202 |
| 0165103 | 8/1985 | Japan | 333/202 |
| 0230703 | 11/1985 | Japan | 333/222 |
| 0135002 | 6/1988 | Japan | 333/222 |
| 0196901 | 8/1989 | Japan | 333/202 |
| 0177701 | 7/1990 | Japan | 333/202 |

*Primary Examiner*—Robert J. Pascal
*Assistant Examiner*—Seung Ham
*Attorney, Agent, or Firm*—Stevens, Davis, Miller & Mosher

[57] ABSTRACT

For removing the variation of resonant frequency of the $\frac{1}{4}\lambda g$ coaxial resonator, which is caused by the external connection as a result of conventional capacitive coupling, a $\frac{1}{4}\lambda g$ line having both ends opened is coupled to the $\frac{1}{4}\lambda g$ resonant line having one end shorted through distributed inductive coupling, so as to provide a basic structure of the dielectric resonator of the invention, which can be arranged in usual various types of circuits such as filters, multiplexers and the like with excellent and stable performances.

10 Claims, 5 Drawing Sheets

DIELECTRIC MULTI-LINE RESONATOR INCLUDING A COUPLING CONDUCTOR LINE MAINLY INDUCTIVELY COUPLED TO A RESONATOR CONDUCTOR LINE

BACKGROUND OF THE INVENTION (1) Field of the Invention

The present invention relates to a dielectric multi-line resonator, including a coaxial resonator providing a one-fourth wavelength line having one end opened and the other end shorted through a dielectric material block surrounded by an earthed conductor, which is used principally for UHF band, particularly for remarkably reducing the variation of resonant frequency in comparison with the conventional one, which is caused by external connection.

(2) Description of the Prior Art

For coupling a coaxial resonator, which is basically formed by providing a one-fourth wavelength line having one end opened and the other end shorted through a dielectric material block surrounded by an earthed conductor, with an external circuit, a capacitive coupling means has been almost exclusively employed mainly by reason of the readiness of composition and manufacture. Concretely speaking, as shown in FIG. 1A, in a typical coaxial resonator formed of an inside wall face conductor 4 of a central hole 3 provided through a dielectric material block 2 of one-fourth wavelength height, which is surrounded by side face conductors 1*a* and a bottom face conductor 1*b*, a terminal conductor 6 supported by an insulator 5 is inserted into the upper end portion of the central hole 3, and hence the external terminal coupling is attained by the capacity between the side face conductor 4 operated as the resonant line and the terminal conductor 6. In the other case, as shown in FIG. 1B, in the coaxial resonator arranged the same as described above, another terminal conductor 8 is inserted into a small hole 7 provided in the upper end portion of the dielectric material block 2 close by the side face conductor 4, and hence the external terminal coupling is attained by the capacity between both of those conductors 4 and 8.

However, the above mentioned capacitive external coupling to the coaxial resonator has a difficulty such that the variation of resonant frequency in response to the extent of coupling to external circuits is extensive, and further precise manufacturing is required by the dependency of the coupling extent on shape and size, in spite of the advantage that the structure is simple, with resulting facilitated manufacturing and further stable coupling can be attained.

On the other hand, with regard to the resonant frequency variation responding to the coupling extent, the inductive coupling based on coils or the like is more tolerant and hence the coupling to external circuits can be stabilized thereby. However, the conventional structure thereof has difficulties such that the manufacturing takes much time and much labor and hence is not suited for mass-production.

SUMMARY OF THE INVENTION

An object of the present invention is to remove the above difficulties and to provide a dielectric multiline resonator basically formed of a coaxial resonator, the structure of which is simple and hence is suited for mass production, and in which the resonant frequency variation caused by coupling to external circuits is removed by adopting a mainly inductive coupling means.

A dielectric multiline resonator according to the present invention is basically arranged such as a coupling conductor line is inserted into a dielectric material block of a coaxial resonator close in parallel with a central resonant conductor line in a state of both ends opened, so as to obtain a mainly inductive coupling to the central resonator conductor line.

In other words, the dielectric multiline resonator of the present invention is featured by comprising a dielectric material block which has top and bottom faces facing to each other in parallel apart from each other substantially by one-fourth of guided wavelength concerned and conductive surrounding side faces being perpendicular to said top and bottom faces, and a plurality of conductive lines which are provided through said dielectric material block with respective axes which are perpendicular to said top and bottom faces of said dielectric material block, wherein at least one of said plurality of conductive lines, one ends on the same one side of which are electrically connected with said conductive side faces and the other ends on the other side are opened, are operated as resonant lines, while at least the other one of said plurality of conductive lines, which are adjacent and coupled to said resonant lines respectively and both ends of which are opened together, are operated as coupling lines, open ends on the other side of which are prepared to be connected with external circuits.

Consequently, in the dielectric multiline resonator of the present invention, a coaxial resonator having a simple and readily manufactured structure, in which the resonant frequency is not varied by coupling to external circuits and the setting of input and output impedances and the small-sizing are ready, can be readily realized.

BRIEF DESCRIPTION OF THE DRAWINGS

For the better understanding of the invention, reference is made to the accompanying drawings, in which.

Throughout different views of the drawings: 1*a* is a side face conductor; 1*b* is a bottom face conductor; 2 is a dielectric material block; 3 is a central hole; 4 is an inside wall face conductor (resonant line); 5 is an insulator; 6, 8 are terminal conductors; 7 is a small hole; 9*a* is an inside wall face conductor (coupling line); 9*b* is a coupling line; 10 is a non-conductive portion; R is a resonant line; C is a coupling line; L is a load; S is a signal source; M is a meter; T is a trap line.

DESCRIPTION OF THE PREFERRED EMBODIMENTS

Various examples of the dielectric multiline resonator according to the present invention will be described hereinafter in detail.

Figure 1A:
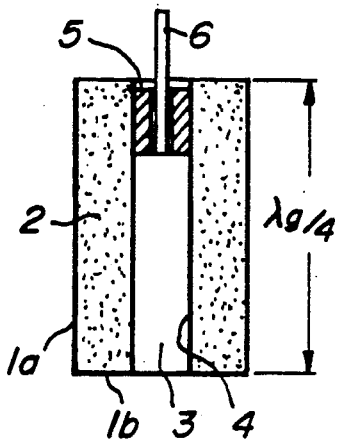
FIG. 1A PRIOR ART
FIGS. 1A and 1B are cross-sectional views showing conventional manners of external coupling to a coaxial resonator respectively, as already mentioned.
Figure 1B:
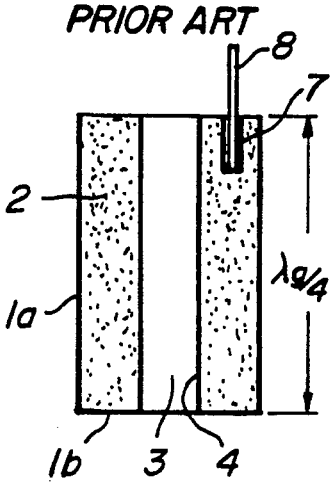
FIG. 1B PRIOR ART
Figure 2A:
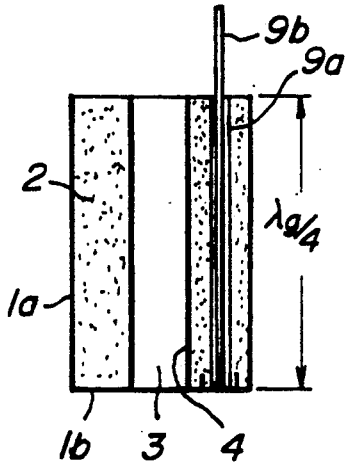
FIGS. 2A, 2B and 2C are a cross-sectional view, a perspective view and an equivalent circuit diagram showing a basic structure of a dielectric multiline resonator according to the present invention respectively.
Figure 2B:
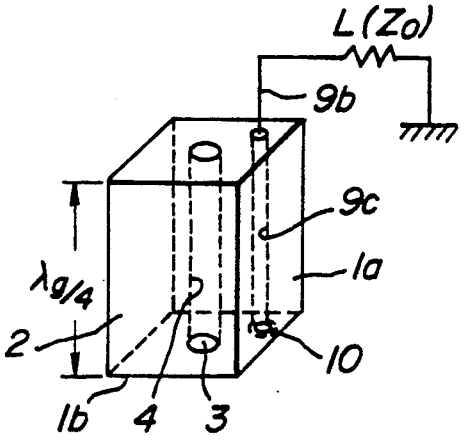
Figure 2C:
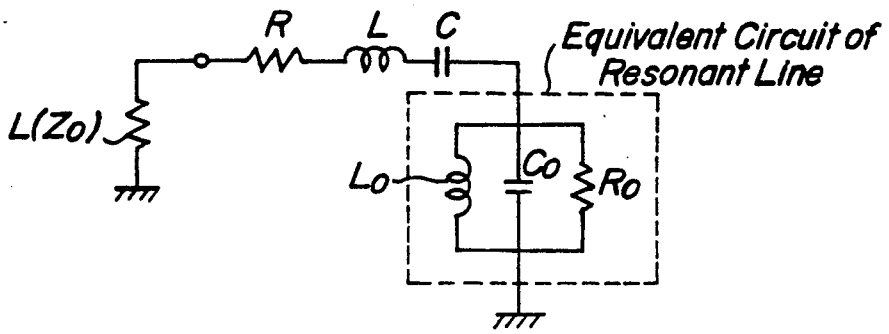

A basic structure of a coaxial resonator according to the present invention, which corresponds to the conventional one as shown in FIGS. 1A and 1B, is shown in FIGS. 2A, 2B and 2C.

As shown in FIG. 2A, in the basic structure according to the present invention, in which a typical coaxial resonator formed of a inside wall face conductor 4 of a central hole 3 provided in a one-fourth wavelength height dielectric material block 2 surrounded by a side face conductor 1*a* and a bottom face conductor 1*b* is applied with the present invention, a hole 9*a* passing through the dielectric material block 2 close to and parallel with the inside wall face conductor 4 of the central hole 3, which is operated as the resonant line, is provided in the block 2, and is operated as a coupling line by inserting a conductor line 9*b* therethrough or by making the inside wall face conductive similarly to the resonant line 4. On this occasion, a portion 10 of the bottom face conductor 1*b*, which surrounds an aperture of the perforating hole 9*a*, is made non-conductive in an appropriate range, so as to provide an inside wall face conductor 9*c* (see FIGS. 2B, 4A, 5, 6A and 7A) of one-fourth wavelength height situated in a state of both ends opened.

For making the inside wall face of hole 9*a* conductive, silver paste is coated and fused thereon similarly to the usual arrangement in this case. Moreover, it is preferable to spread the coated film within the non-conductive portion 10 of the bottom face conductor 1*b* around the aperture of the perforating hole 9*a*. In this connection, the impedance of the coupling line formed of the inside wall face conductor 9*c* is varied by the shape and the size of the perforating hole 9*a*, the distance from the resonant line 4 and the side face conductor 1*a* or the like, and further can be appropriately set up, for instance, by mixing resistive material into silver paste and hence the impedance matching to the coupled external circuit can be attained.

The open end of the coupling line provided by inside wall face conductor 9*c* on the same side as that of the resonant line 4, as shown in FIG. 2B, is coupled to external circuits by terminating through a load L corresponding to the characteristic impedance Zo thereof.

In a distributed coupling obtained between the resonant line 4 formed of one-fourth wavelength conductor having one end opened and the other end shorted and the coupling line formed of the same having both ends opened, the capacitive coupling is dominant along the upper half thereof, while the inductive coupling is dominant along the lower half thereof. Consequently, according to the present invention, the object of which is to remove the resonant frequency variation caused by the external coupling through the employment of inductive coupling to the resonant line, the length of the coupling line should be set beyond the midpoint from the open end of the resonant line 4, that is, longer than one-eighth wavelength. However, it is preferable in practice to select the one-fourth wavelength, so as to minimize the resonant frequency variation caused by the external coupling.

An equivalent circuit of the above-mentioned basic structure of the resonator according to the present invention, consists of a series connection of a parallel resonant circuit equivalent to the resonant line 4 and a series resonant circuit equivalent to the coupling line, as shown in FIG. 2C. The capacitive variation of one of those resonant circuit impedances and the inductive variation of the other thereof are canceled by each other and hence the impedance variation caused by the external coupling is removed. As a result, an excellent wideband external coupling performance can be attained.

Figure 3C:
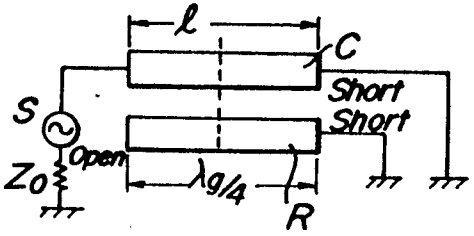
FIGS. 3A, 3B and 3C are diagrams showing the operational principle of external coupling according to the present invention in order.
Figure 3B:
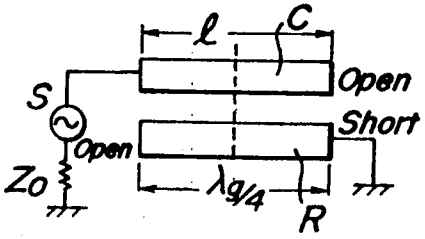
Figure 3A:
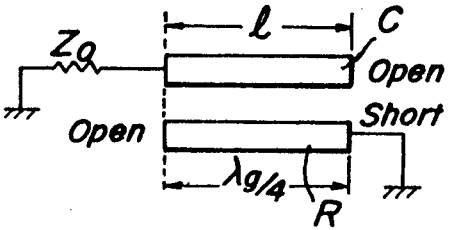

The above described basic structure of the resonator according to the present invention is equivalent to a strip line structure as shown in FIG. 3A and hence is operated similarly as the strip line structure in which a coupling line C having a length l which exceeds one-eighth wavelength disposed close to and in parallel with a resonant line R having a one-fourth wavelength of one end shorted in a state such as respective open ends are arranged alternately with each other.

In the one fourth wavelength resonant line having one end shorted and the other end opened, an inductive potential distribution is obtained on the shorted end side from the midpoint, while a capacitive potential distribution is obtained on the open end side therefrom. As a result, in a state wherein the resonant line R and the coupling line C are arranged close to and in parallel to each other with respective open ends alternately directed, as shown in FIG. 3B, respective capacitive and inductive potential distributions alternately arranged with regard to the midpoint of one-eighth wavelength interact throughout those lines and hence the wide band mutual coupling is obtained. On the contrary, in a state wherein those lines R, C are arranged close in parallel to each other with respective open ends directed in the same direction as shown in FIG. 3C, respective capacitive and inductive potential distributions repel each other and hence any mutual coupling cannot be obtained.

In a dielectric multiline resonator formed by combining plural conductor lines similarly to the usual arrangement, under the application of the resonator according to the present invention, which has the above mentioned basic structure with good coupling property, an excellent performance in comparison with conventional resonators of the same kind can be obtained and further the structure can be simplified and small-sized.

Several examples of a dielectric multiline resonator according to the present invention will be described hereinafter by referring to respective drawings.

Figure 4B:
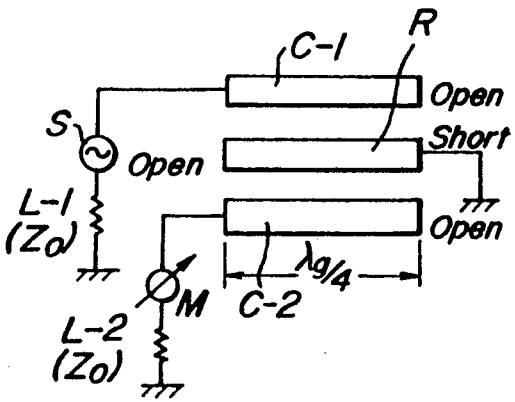
FIGS. 4A and 4B are a perspective view and an equivalent strip line diagram showing an example of a band pass filter according to the present invention respectively.
Figure 4A:
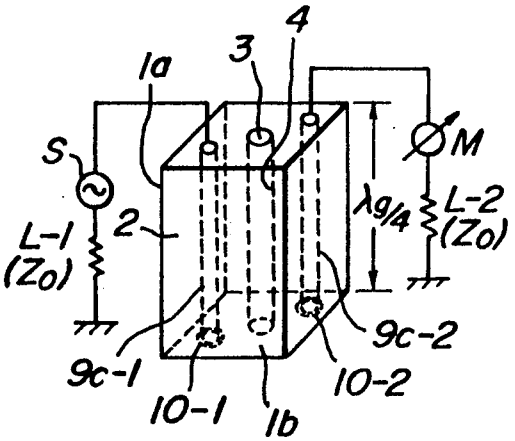

An example of a bandpass filter, a perspective view of which is shown in FIG. 4A and an equivalent strip line diagram of which is shown in FIG. 4B, is arranged such that two coupling lines 9*c*-1(C1) and 9*c*-2(C2) are closely arranged in front and rear of a resonant line 4(R) as input and output lines respectively, so as to obtain a single peak pass band.

Figure 5:
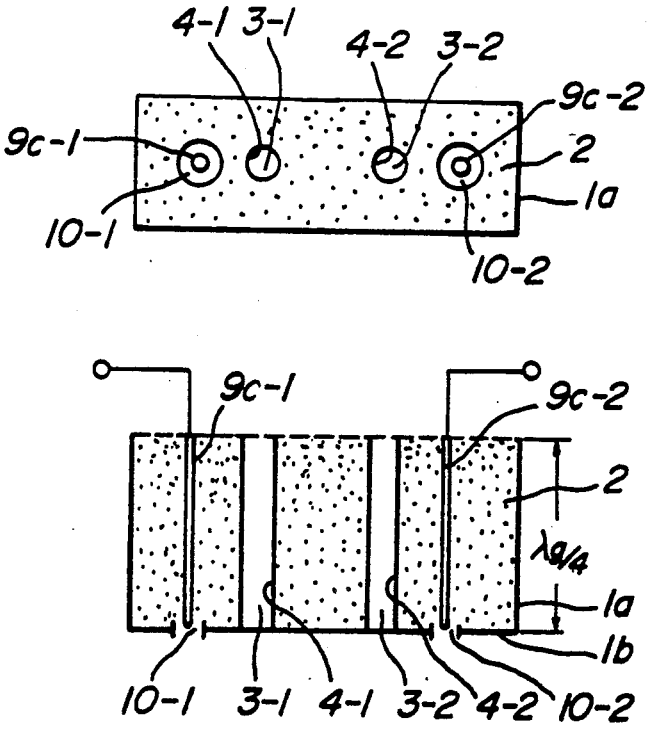
FIG. 5 is a cross-sectional plan and a cross-sectional elevation showing another example of the same.

Another example of the same, a cross-sectional plan view and a cross-sectional elevation view of which are shown in FIG. 5, is arranged such that two coupling lines 9*c*-1 and 9*c*-2 are closely arranged in front and rear of two mutually coupled resonant lines 4-1 and 4-2 as input and output lines respectively, so as to obtain a double peak bandpass. In this connection, the coupling between two resonant lines 4-1, 4-2 consists, in general, of capacitive or inductive coupling. However, it is omitted in the drawings similarly as in the subsequent drawings.

Figure 6A:
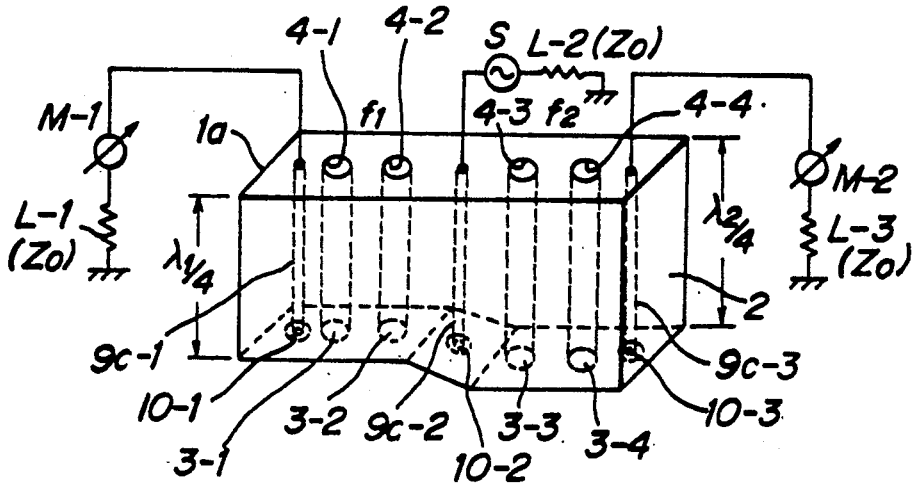
FIGS. 6A and 6B are a perspective view and an equivalent strip line diagram showing an example of a multiplexer according to the present invention respectively.
Figure 6B:
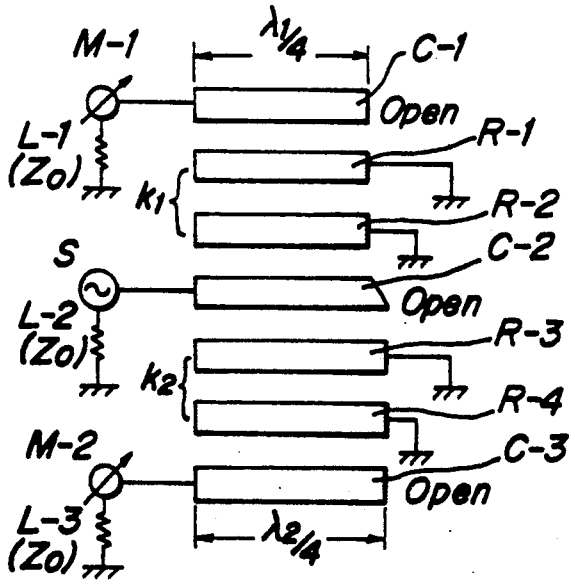

A multiplexer, a perspective view of which is shown in FIG. 6A and an equivalent strip line diagram is shown in FIG. 6B, is arranged such that respective two resonant lines 4-1,2 and 4-3,4, which have respective resonant frequencies $f_1$ and $f_2$ and are coupled in order respectively, are closely arranged in front and rear of a coupling line 9*c*-2 operated as an input line respectively, and further, in front and rear of those resonant lines, two coupling lines 9*c*-1 and 9*c*-3 are closely arranged as output lines respectively, so as to separate from each other two high frequency powers, which have respective frequencies $f_1$ and $f_2$, and are mixed with each other and supplied through the common input line 9*c*-2 and to take out those powers through output lines 9*c*-1 and 9*c*-3 respectively.

However, in case that resonant frequencies $f_1$ and $f_2$ are identical to each other, it is operated as a power splitter. In this connection, the height of the dielectric material block 2, or, the length of the resonant line R, is naturally set up to one fourth of respective wave lengths in response to the difference between those wavelengths.

Figure 7A:
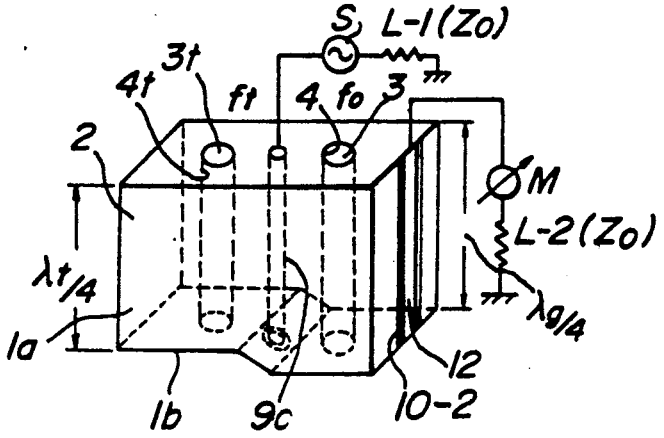
FIGS. 7A and 7B are a perspective view and an equivalent strip line diagram showing an example of a trap filter according to the present invention, respectively.
Figure 7B:
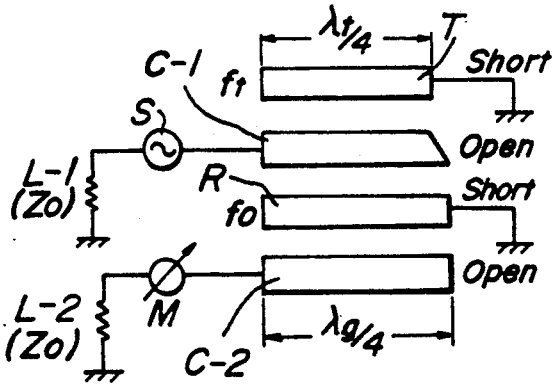

An example of a trap filter, a perspective view of which is shown in FIG. 7A and an equivalent strip line diagram of which is shown in FIG. 7B, is arranged such that, on the opposite side of an input coupling line 9*c* arranged close by a resonant line 4 which has a single peak pass-band, another resonant line 4*t*, which has a resonant frequency corresponding to the stopping or trapping frequency ft, is closely arranged, and further, a portion of the side face conductor 1*a*, which portion is close by the bandpass resonant line 4, is made non-conductive, so as to operate a strip line 12 provided on the non-conductive portion concerned similarly as the coupling line 9*b* in the basic structure as shown in FIG. 2A as an output line.

As is apparent from the above description, according to the present invention, the following special effect can be obtained.

The variation of the resonant frequency in the dielectric multiline resonator basically consisting of the coaxial resonator, which variation is caused by the coupling to external circuits, can be remarkably reduced, and hence the wideband coupling can be stably attained.

Moreover, the structure of the external coupling means is considerably simplified in comparison with the conventional means, and hence can be readily manufactured, so as to readily obtain products having uniform properties in mass-production.

What is claimed is:

1. A dielectric multiline resonator comprising:

a dielectric material block which has top and bottom faces which face each other in parallel relationship and are spaced apart from each other substantially by one-fourth a wavelength of a wave to be guided thereby and at least mostly conductive surrounding side faces which are perpendicular to said top and bottom faces, and a plurality of conductive lines which are provided through said dielectric material block, which have respective axes which are perpendicular to said top and bottom faces of said dielectric material block and which are consecutively coupled with each other inductively through no mediation, wherein at least one conductive line of said plurality of conductive line is a resonant line having one end electrically connected with said conductive side faces and another end open-circuited relative to all other conductive components of said resonator, at least one other conductive line of said plurality of conductive lines is a coupling line and is adjacent to and primarily inductively coupled to said resonant line, both ends of said coupling line being open-circuited relative to all other conductive components of the resonator and one of said ends being for connection with external circuits, so as to be inductively coupled with said external circuits.

2. A dielectric multiline resonator as claimed in claim 1, wherein said resonant line is formed by a conductive inside wall face of a hole bored through said dielectric material block substantially perpendicularly to said top and bottom faces, said bottom face of said dielectric material block is conductive and electrically connected with said conductive side faces and said conductive inside wall face.

3. A dielectric multiline resonator as claimed in claim 1, wherein said coupling line is formed by a conductive portion of an inside wall face of a hole bored through said dielectric material block substantially perpendicularly to said top and bottom faces, said conductive portion extending from the top face at least beyond a midpoint of said hole.

4. A dielectric multiline resonator as claimed in claim 2, wherein said coupling line is formed by a conductive portion of an inside wall face of a hole bored through said dielectric material block substantially perpendicularly to said top and bottom faces, said conductive portion extending from the top face at least beyond a midpoint of said hole, said conductive portion being not electrically connected to said conductive bottom face.

5. A dielectric multiline resonator as claimed in claim 2, wherein said coupling line is provided by a conductive inside wall face of a hole bored through said dielectric material block substantially perpendicularly to said top and bottom faces, said bottom face including a non-conductive portion which closely surrounds a conductive aperture of said hole.

6. A dielectric multiline resonator as claimed in claim 2, wherein said resonant line is formed by a conductive inside wall face of a hole bored through said dielectric material block close to said side face and substantially orthogonal to said top and bottom faces, a portion of said side face which is parallel to said resonant line being non-conductive, and said coupling line is formed by a conductive strip line which is provided within said non-conductive portion of said side face in parallel with said resonant line.

7. A dielectric multiline resonator as claimed in claim 1, wherein two of said plurality of conductive lines are operated as a said coupling line, said two of said plurality of conductive lines being coupled to said resonant line as input and output lines respectively, so as to operate said resonator as a bandpass filter.

8. A dielectric multiline resonator as claimed in claim 1, wherein said coupling line is operated as at least one of an input line and an output line and said resonant line is operated as a trap filter.

9. A multiplexer, comprising:

a dielectric material block which has top and bottom faces which face each other in parallel relationship and are spaced apart from each other substantially by one-fourth a wavelength of a wave to be guided thereby and at least mostly conductive surrounding side faces which are perpendicular to said top and bottom faces, and a plurality of conductive lines which are provided through said dielectric material block and which have respective axes which are perpendicular to said top and bottom faces of said dielectric material block and which are consecutively coupled with each other inductively through no mediation, wherein a first pair of adjacent ones of said conductive lines and a second pair of adjacent ones of said conductive lines are resonant lines each having one end electrically connected with said conductive side face and another end open-circuited relative to all other conductive components of said multiplexer, a first one, a second one and a third one of said conductive lines are coupling lines primarily inductively coupled to said resonant lines and having both ends open-circuited relative to all other conductive components of said multiplexer, said first one, said first pair of conductor lines, said second one, said second pair of conductor lines and said third one being arrayed in that order, said first one and said first pair of conductor lines constituting a first bandpass filter and said third one and said second pair of conductor lines constituting a second bandpass filter having a different resonant frequency from that of said first bandpass filter, said first one and said third one operating as output lines and said second one operating as an input line in common to said first bandpass filter and said second bandpass filter.

10. A power splitter, comprising:

a dielectric material block which has top and bottom faces which face each other in parallel relationship and are spaced apart from each other substantially by one-fourth a wavelength of a wave to be guided thereby and at least mostly conductive surrounding side faces which are perpendicular to said top and bottom faces, and a plurality of conductive lines which are provided through said dielectric material block and which have respective axes which are perpendicular to said top and bottom faces of said dielectric material block and which are consecutively coupled with each other inductively through no mediation, wherein a first pair of adjacent ones of said conductive lines and a second pair of adjacent ones of said conductive lines are resonant lines each having one end electrically connected with said conductive side face and another end open-circuited relative to all other conductive components of said power splitter, a first one, a second one and a third one of said conductive lines are coupling lines primarily inductively coupled to said resonant lines and having both ends open-circuited relative to all other conductive components of said power splitter, said first one, said first pair of conductor lines, said second one, said second pair of conductor lines and said third one being arrayed in that order, said first one and said first pair of conductor lines constituting a first bandpass filter and said third one and said second pair of conductor lines constituting a second bandpass filter having a same resonant frequency as that of said first bandpass filter, said first one and said third one operating as output lines and said second one operating as an input line in common to said first bandpass filter and said second bandpass filter.

* * * * *